United States Patent [19]

Riedl

[11] Patent Number: 4,828,308

[45] Date of Patent: May 9, 1989

[54] SNAP LOCK FOR ATTACHMENT MEMBER ON TRANSPORTABLE LARGE CONTAINERS, ESPECIALLY FOR CONNECTING PARTS OF A LIFTING AND DEPOSITING DEVICE FOR SUCH LARGE CONTAINERS

[75] Inventor: Reinhold Riedl, Miltenberg, Fed. Rep. of Germany

[73] Assignee: haacon hebetechnik GmbH, Freudenberg/Main, Fed. Rep. of Germany

[21] Appl. No.: 95,826

[22] Filed: Sep. 10, 1987

[30] Foreign Application Priority Data

Sep. 10, 1986 [DE] Fed. Rep. of Germany ..... 3630804

[51] Int. Cl.[4] ..... B66C 1/22

[52] U.S. Cl. ..... 294/81.53; 410/83

[58] Field of Search ..... 294/81.53, 81.52, 67.32; 410/82, 83

[56] References Cited

U.S. PATENT DOCUMENTS 3,751,096 8/1973 Wyon ..... 294/81.53

4,697,967 10/1987 Schulz et al. ..... 410/82

*Primary Examiner*—James B. Marbert

*Attorney, Agent, or Firm*—Frank P. Presta

[57] ABSTRACT

Lifting and depositing devices which have four rack and pinion jacks are used to raise and lower transportable large containers or to support them above the ground, and the jacks can be attached to a container by arms reaching to the ISO corner fittings of the container. Each arm has a connecting beam which is approximately the height of the container, which is supported by means of a journal arranged at its top end parallel and at some distance therefrom in a top ISO corner fitting an is detachably fastened to its bottom end by an angled connecting part by means of two snap locks. In order to allow this fastening to the bottom ISO corner fitting, at least, the one snap lock is configured as a modular removably structural part. The snap lock, however, is also suitable for other attachment components, for instance pulley blocks or roller trestles for large containers.

3 Claims, 5 Drawing Sheets

SNAP LOCK FOR ATTACHMENT MEMBER ON TRANSPORTABLE LARGE CONTAINERS, ESPECIALLY FOR CONNECTING PARTS OF A LIFTING AND DEPOSITING DEVICE FOR SUCH LARGE CONTAINERS

BACKGROUND OF THE INVENTION

The present invention relates to a snap lock for attachment members on transportable large containers, especially for connecting carts of a lifting and depositing device for such large container, e.g., containers, shelters, compartments or the like, which have ISO corner fittings with slots, with which in turn a snap lock can be brought into engagement, and the snap lock has a lock bolt with a mushroom-type head which can slide axially counter to spring pressure and can be rotated, and of which the length is greater than the width of the slots in the ISO corner fittings and which can be rotated 90 degrees out of an inoperative assembly or inserted position into an operative clamped position and can be secured against the inside of the relevant ISO corner fitting by a clamp nut on the lock bolt.

A known lifting and depositing device for transportable large containers has four rack and pinion jacks, of which the arms can be attached by connecting beams and by means of snap locks to the ISO corner fittings of the relevant container. The arrangement is configured for this purpose so that each connecting beam is suspended with a journal rigidly fastened parallel to the connecting beam on a cantilevered arm in a top ISO corner fitting, while the bottom end of the connecting beam is affixed on the relevant bottom ISO corner fitting by a cantilevered arm by means of a horizontal snap lock. For this purpose, this snap lock is incorporated tightly in the relevant cantilevered arm projecting to the side at the bottom end of the connecting beam and is provided with a salient which fits exactly into the slot of the bottom ISO corner fitting. Then, however, it is impossible to arrange two such snap locks over each corner and to bring them into simultaneous engagement with one of the bottom ISO corner fittings of the large container, which is undesirable because of the high degree of stability required if it has to do with particularly heavy containers which are hard to move. German Utility Patent No. 82 35 609.2 actually discloses a solution, wherein the arm of a lifting and depositing device for large containers can be fastened by means of one rigid and one axially movable journal on one corner fitting of a large container. This construction however cannot be applied to the aforementioned snap locks for ISO corner fittings without overcoming further problems.

Another drawback of the snap locks which are constructed rigidly incorporated in the connecting parts of the lifting and depositing device resides in that in case of a defect, the entire arm may have to be subjected to a spring fracture for the repair procedure. Also the incorporated snap locks increase the weight of the connecting parts of the device, which as is known are intended to be easy to carry and dismountable into parts for storage. A requirement then exists for a snap lock for any structural attachment part.

SUMMARY OF THE INVENTION

A primary object of the present invention is to provide a snap lock which overcomes the aforementioned difficulties and can be used in various ways, in order to fasten attachment components simply, rapidly and securely to an ISO corner fitting of a large container. The repair of the snap lock is also to be simplified and the weight of the attachment components reduced by the invention.

The above object is attained according to the present invention in that the snap lock is configured as an exchangeable structural part in which the lock bolt is mounted with its pre-biased spring in a housing which has a mounting head facing the clamp nut and in this arrangement the main part of the housing has a diameter corresponding to the small dimension of a slot of an ISO corner fitting, and the connecting part includes a slot for the fitted reception of the main housing part, which can be brought into alignment with a slot of an ISO corner fitting. It is therefore possible to assemble two snap locks one after the other on the (top or bottom) ISO corner fittings of a large container, over the corners, so that the better stability which is then required with especially heavy and movable large containers is attained. The snap lock is suitable for any attachment components, especially for connecting parts of lifting and depositing devices for large containers.

After use of a lifting and depositing device the snap locks according to the invention could be removed from their connecting parts, so that their relevant weight per piece is decreased. Also, in case of a defect in a snap lock, this defective unit can be separated from the attachment component or from the connecting parts of the lifting and depositing device for repair so that the maintenance of the exchangeable snap lock is easier than that of devices of the present state of the art. The exchangeable snap lock according to the invention can advantageously also be combined with a rigid snap lock incorporated in an attachment component and thus may also be retrofitted without complication. Another example of an attachment component is a pulley block or roller trestle.

Various configurations of the present invention are disclosed in the specification and claims. When a slot is cut out at the end of the main part of the housing, where it faces the mounting head and is intended for the fitted reception of the mushroom-type head of the lock bolt in its clamped position, it is guaranteed that with rotation of the lock bolt out of its inserted position into its clamped position, when the clamped position has been reached, the mushroom-type head is locked in the slot by spring pressure and thus is blocked and prevented from rotating further. The operator thus receives the indication that the snap lock is then in its locked position If the mounting head is configured as a truncated cone on the snap lock housing, a weight reduction of the snap lock is attained.

Still another configuration of the invention is characterized in that the housing main part and the lock bolt of the snap lock are of such lengths that they serve for the common clamping together of several attachment components. These attachment components may be, for instance, an arm of a lifting and depositing device and the relevant connecting part of a pulley block or roller trestle.

BRIEF DESCRIPTION OF THE DRAWINGS

The invention is now to be explained hereinafter relative to the drawings of one exemplary embodiment. In the drawings.

DESCRIPTION OF THE PREFERRED EMBODIMENTS

Figure 1:
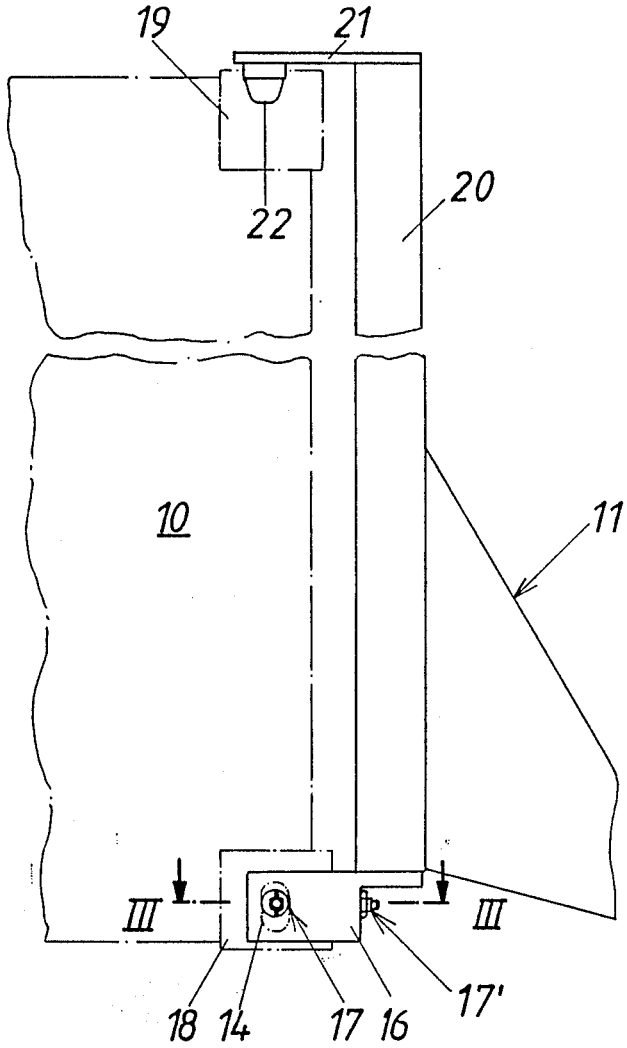
FIG. 1 is a side elevational view of a container corner, to the bottom ISO corner fitting of which is fastened a connecting beam of approximately the container height of a lifting and depositing device, held by means of two snap locks, of which one is configured according to the present invention.

A lifting and depositing device for a large container 10 has four arms 11 of identical structure detachably attached to its corners, which are associated with a rack and pinion jack (not shown) by means of which the large container 10 can be raised and lowered. On each corner of container 10 are provided ISO corner fittings 19 and 18 at the top and bottom, respectively, to which can be attached a connecting beam 20 of arm 11 which is approximately the height of the container 10 and over the corners at some distance therefrom. Connecting beam 20, which may be a quadrangular pipe in an exemplary embodiment, is provided at its top end with a cantilevered arm 21 projecting to the side, to which is fastened a journal 22 which projects downwardly and substantially parallel to connecting beam 20. Journal 22 is fitted securely into a suitable opening in the top of top ISO corner fitting 19 with the mounting of connecting beam 20 and arm 11, and at the beginning of the assembly arm 11 can be "suspended" from large container 10. Then the bottom end of connecting beam 20 is connected detachably with the bottom ISO corner fitting 18. At the bottom end of connecting beam 20 is fastened a right-angle connecting member 16, which is reinforced by a reinforcement plate 15 (FIG. 3) which is welded to it. The bottom ISO corner fitting 18 has two perpendicular slots 14 over the corners, with which an exchangeable snap lock 17 can be brought into engagement. The other snap lock 17' is simply tightly incorporated in connecting part 16 and likewise an exchangeable snap lock 17 can be provided at its position. This last construction is preferred for various reasons which were explained initially herein.

Exchangeable snap lock 17 has a lock bolt 23, which carries a mushroom-type head 24 at its one end and is provided with a threaded segment 25 at its other end. A clamp nut 26 which has a control grip 27 on its hexagonal part is screwed onto this threaded segment 25. Lock bolt 23 is provided with a cylindrical bearing segment 28 and another cylindrical bearing segment 29 which is of reduced diameter.

Snap lock 17 comprises a housing 30, which is composed of a housing main part 31 and a mounting head 32. Housing main part 31 has a diameter which corresponds to the small dimension of slots 14 in the ISO corner fitting 18. When snap lock 17 is assembled, this housing main part 31 extends through the slot 14 and also through a slot 33 in connecting part 16, which is aligned with the relevant slot 14 and has the same diameter as this slot. Mounting head 32 is configured in the exemplary embodiment as a truncated cone so that when snap lock 17 is assembled (FIG. 3) it rests on the outside of connecting part 16.

Figure 2:
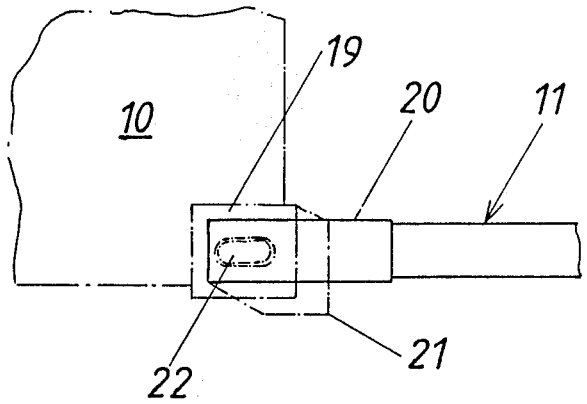
FIG. 2 is a plan view of the container corners with the connecting beam as in FIG. 1.

Snap lock housing 30 has a borehole 34, in which are incorporated a compression spring 35 and a bearing bushing 36 which is axially movable. Lock bolt 23 is mounted rotatably and axially movable in housing 30. Viewed in detail, the bearing segment 28 of lock bolt 23 rests in a housing bore 37, while bearing segment 29 is mounted in the bushing 36. A shim 38 is placed between clamp nut 26 and mounting head 32. A detent 39 fastened on the outside end of lock bolt 23 prevents inadvertent deviation of clamp nut 26 from lock bolt 23. A slot 40 running transverse to the axle is worked into the end of housing main part 31 facing mounting head 32, into which engages and locks the mushroom-type head 24 in its clamped position shown in FIGS. 2 and 6 under pressure from spring 35.

Insofar as the tightly incorporated snap lock 17' corresponds to the exchangeable snap lock 17, identical parts are identified with the same reference numerals. Lock bolt 23' of snap lock 17' has an extended cylindrical bearing segment 28' and is mounted in a bore 37', which is provided in connecting part 16.

Figure 3:
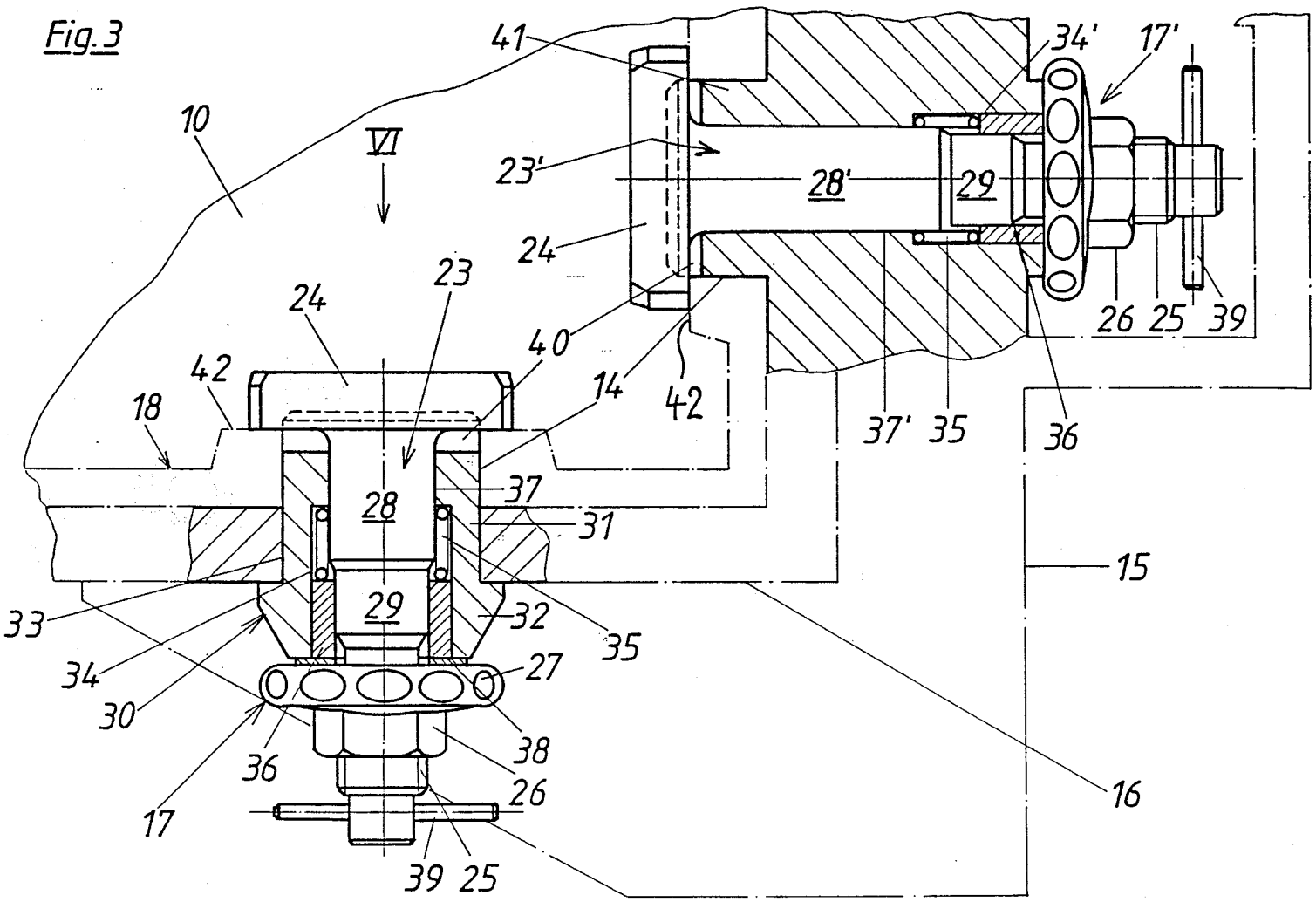
FIG. 3 is a cross sectional view taken substantially along line III—III of FIG. 1, but in larger scale.

Furthermore, a salient 41 is provided on connecting part 16, of which the dimensions correspond to the small dimension of the other slot 14 in the ISO corner fitting 18. Salient 41 also includes the slot 40, into which mushroom-type head 24 is locked in its clamped position shown in FIG. 3. Bearing bushing 36 and compression spring 35 are incorporated in a borehole 34' in connecting part 16. Both snap lock 17 and 17' are shown in FIG. 3 in their clamp positions, in order to tightly connect connecting part 16 to connecting beam 20 with ISO corner fitting 18 and/or large container 10.

For the fitting of connecting beam 20 and/or arm 11 to large container 10, beam 20, as already explained, is first suspended with journal 22 in top ISO corner fitting 19. Then connecting part 16 is in position with bottom ISO corner fitting 18. With this procedure, the exchangeable snap lock 17 is not yet mounted and salient 41 on connecting part 16 can thus be introduced into the relevant slot 14 of ISO corner fitting 18. Mushroom-type head 24 is then in the assembly or inserted position for snap lock 17 shown in FIGS. 4 and 5. Following the insertion of salient 41 into the relevant slot 14, lock bolt 23' is rotated around 90 degrees into its clamped position, which is shown in FIGS. 3 and 6. As a result of this mushroom-type head 24 meshes into slot 40 under the influence of compression spring 35 and comes into alignment with a bearing surface 42 on the inside of ISO corner fitting 18. Now, snap lock 17' can be prebiased with suitable rotation of clamp nut 26.

Figure 4:
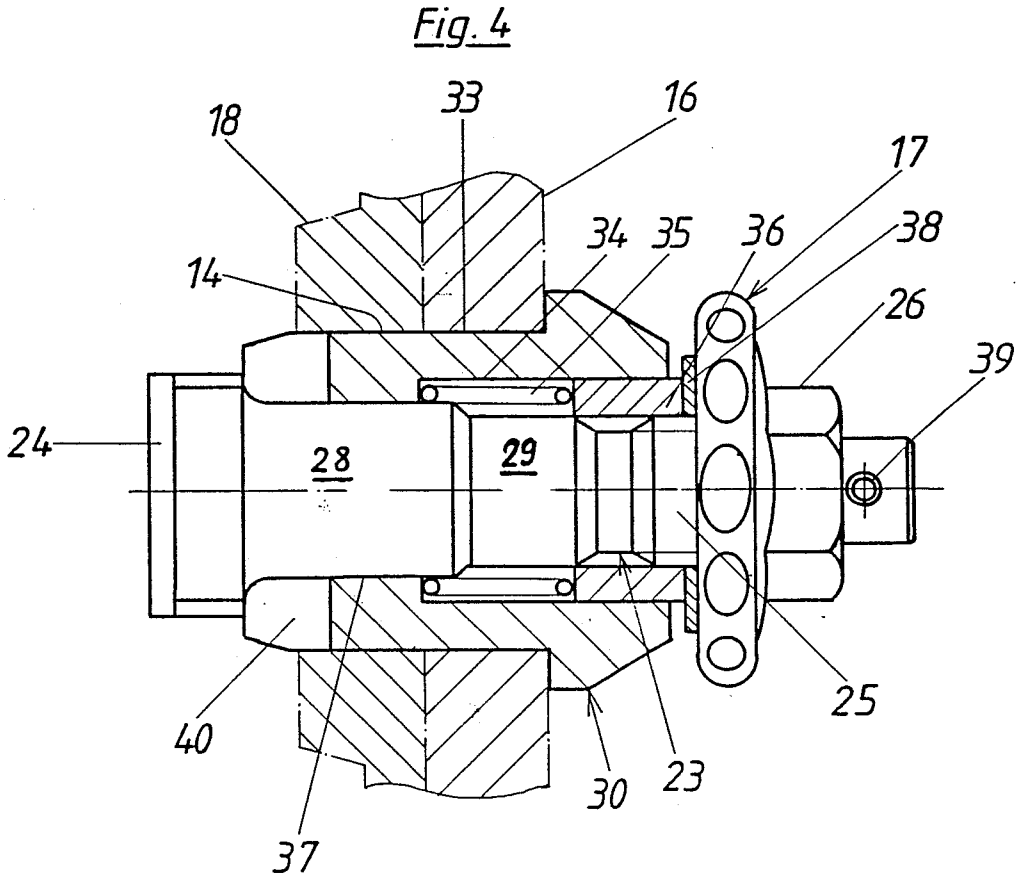
FIG. 4 is a lengthwise sectional view of the exchangeable snap lock shown on the left in FIG. 3, in a state in which it can be mounted or dismounted.
Figure 5:
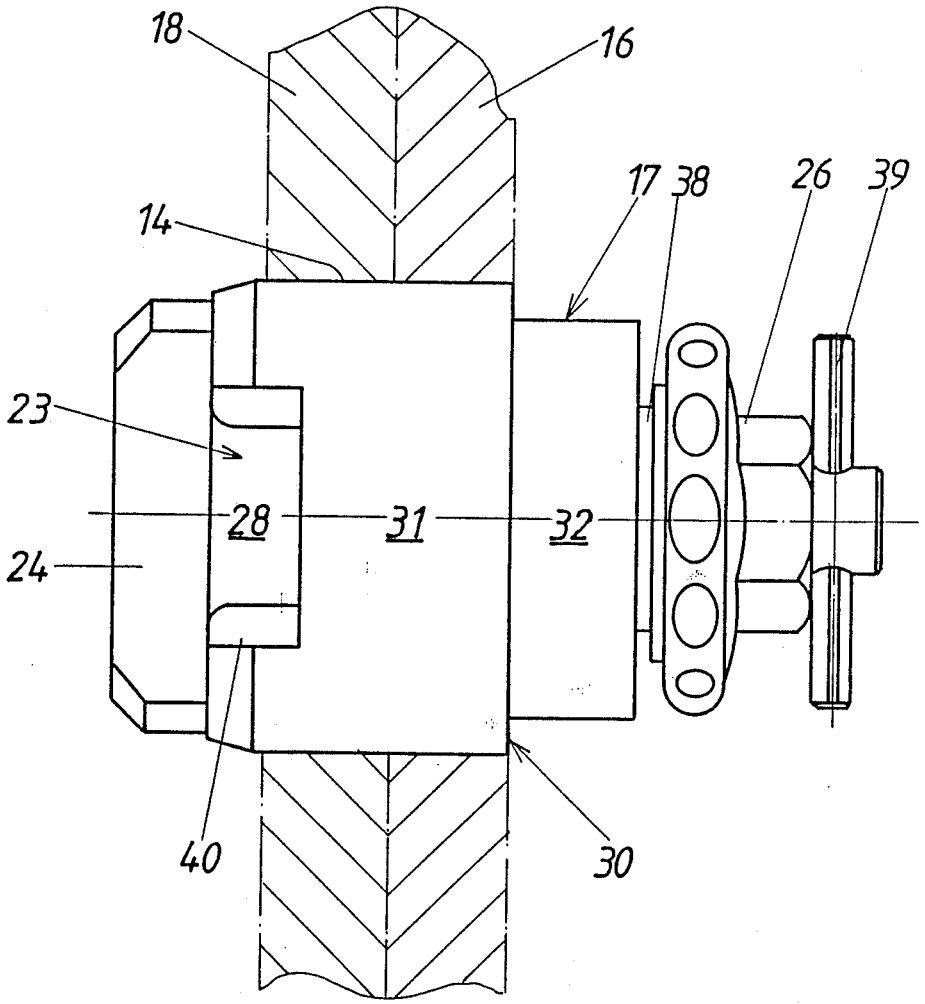
FIG. 5 is a side elevational view of the exchangeable snap lock shown in FIG. 4, rotated 90 degrees from the position in FIG. 4.
Figure 6:
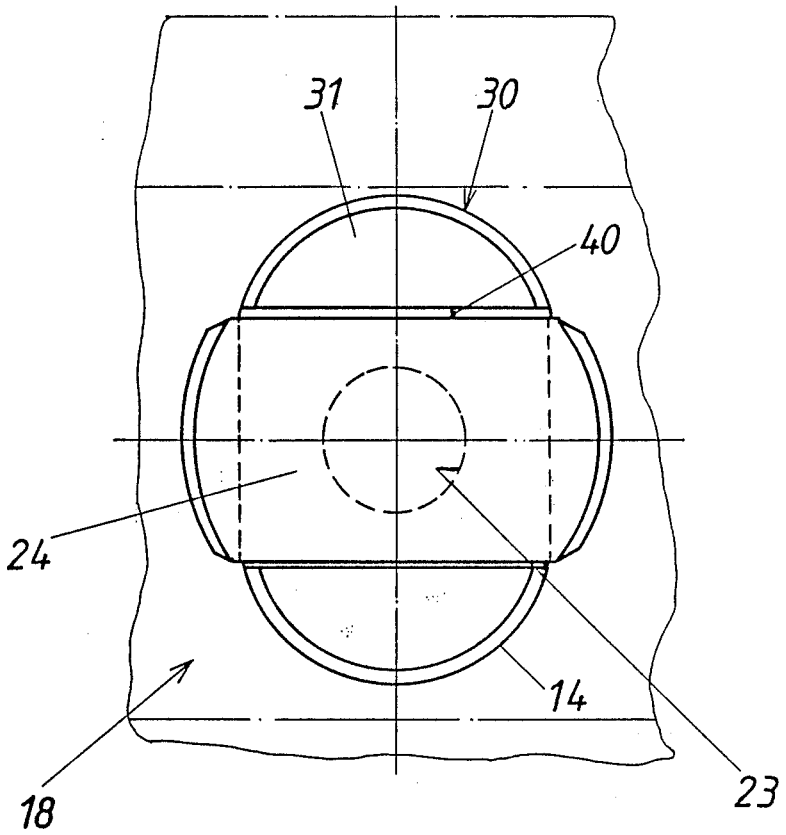
FIG. 6 is a front view of the exchangeable snap lock viewed in the viewing direction of the arrow VI in FIG. 3, in which the snap lock is in its clamped position.

Then exchangeable snap lock 17 is inserted in its assembly state shown in FIGS. 4 and 5 with housing main part 31 in slots 33 and 14 of ISO corner fitting 18, until mushroom-type head 32 engages on the outside of connecting part 16. Mushroom-type head 24 then with this procedure takes the inserted position shown in FIGS. 4 and 5. Then lock bolt 23 is rotated 90 degrees, whereupon mushroom-type head 24 meshes and locks automatically in slot 40 on housing 30 under the force of compression spring 35. Then mushroom-type head 24 comes into alignment with another bearing surface 42 on ISO corner fitting 18. In this connection, snap lock 17 can also be pre-biased by a suitable rotation of clamp nut 26, whereupon the bottom end of connecting beam 20 and/or its connecting part 16 is connected tightly with the bottom ISO corner fitting 18 on large container 10.

With the disassembly of connecting beam 20 the process is carried out in reverse order. First snap lock 17 is removed, and this is accomplished by loosening of clamp nut 26 until lock bolt 23 can be thrust axially inwardly so that mushroom-type head 24 lies outside slot 40 and lock bolt 23 then can be rotated 90 degrees, in order to bring mushroom-type head 24 out of its operating or inserted position (FIGS. 4 and 5). Then snap lock 17 can be removed from slots 14 and 33. Now clamp nut 26 of snap lock 17' is loosened and lock bolt 23' is thrust inwardly and rotated 90 degrees, so that mushroom-type head 24 can be withdrawn through slot 14 in ISO corner fitting 18, when connecting part 16 is pivoted away from large container 10. Then connecting beam 20 need only be raised, in order to bring journal 22 out of engagement with ISO corner fitting 19. It is noted that the ratios at all four corners of large container 10 are identical and as a result each bottom ISO corner fitting 18 can be associated with one exchangeable snap lock 17 and one tightly fastened snap lock 17' as shown in FIG. 3.

For each bottom ISO corner fitting 18 it is also possible to provide two exchangeable snap locks 17. In this case only one second slot 33 is provided in each connecting part 16 and the salient 41 on connecting part 16 can be omitted.

Snap lock 17 is also suitable for other attachment components and can be fixed to bottom and/or top ISO corner fittings of a larger container or the like.

What is claimed is:

1. Snap lock for attaching parts which are to be fitted to transportable large containers, especially for connection parts of a lifting and depositing device for such large containers, which have ISO corner fittings with oval slots, with which a snap lock can be brought into engagement, and the snap lock has a lock bolt with a locking head which is axially slidable counter to spring pressure and is rotatable, of which the length is greater than the width of the oval slots in the ISO corner fittings and which can be rotated out of an inoperative position through an angle of substantially 90 degrees into an operative clamped position and can be tightened by a clamp nut on the lock bolt against the inside side of the relevant ISO corner fitting, and furthermore the lock bolt (23) is mounted with a pre-loaded spring (35) in a housing (30), which has a mounting head (32) opposing the clamp nut (26) and attached to a housing main part (31), characterized in that the snap lock (17) is configured as an exchangeable structural part, the housing main part (31) has a diameter corresponding to the smaller diameter of an oval slot (14) of an ISO corner fitting (18), the connection part (16) includes an oval slot (33) for the housing main part (31), which may be brought into alignment with an oval slot (14) of an ISO corner fitting (18), and in that at the end of the housing main part (31), which lies adjacent to the mounting head (32), a slot (40) is formed for the adaptation and holding of the locking head (24) of the lock bolt (23) in its operative clamped position wherein it is held in the slot (40) by the spring (35).

2. Snap lock as in claim 1, characterized in that the mounting head (32) on the snap lock housing (30) is configured in the form of a truncated cone.

3. Snap lock as in claim 1, characterized in that the lengths of the housing main part (31) and lock bolt (23) of the snap lock (17) are of such dimensions as to facilitate the joint fastening of a plurality of attaching parts.

* * * * *